US010905164B2

(12) United States Patent
Moorman

(10) Patent No.: US 10,905,164 B2
(45) Date of Patent: Feb. 2, 2021

(54) VAPORIZER HAVING ADJUSTABLE ATOMIZER AND REMOVABLE SCREEN

(71) Applicant: Wallace Dray Moorman, Pompano Beach, FL (US)

(72) Inventor: Wallace Dray Moorman, Pompano Beach, FL (US)

( * ) Notice: Subject to any disclaimer, the term of this patent is extended or adjusted under 35 U.S.C. 154(b) by 361 days.

(21) Appl. No.: 16/048,820

(22) Filed: Jul. 30, 2018

(65) Prior Publication Data

US 2019/0029319 A1 Jan. 31, 2019

Related U.S. Application Data

(60) Provisional application No. 62/538,720, filed on Jul. 30, 2017.

(51) Int. Cl.

| | |
|---|---|
| ***A24F 47/00*** | (2020.01) |
| ***A24F 9/02*** | (2006.01) |
| ***A24F 7/04*** | (2006.01) |
| ***A24F 7/02*** | (2006.01) |
| ***A24F 40/40*** | (2020.01) |
| ***A24F 40/20*** | (2020.01) |

(52) U.S. Cl.

CPC ..... *A24F 47/008* (2013.01); *A24F 7/02* (2013.01); *A24F 7/04* (2013.01); *A24F 9/02* (2013.01); *A24F 40/20* (2020.01); *A24F 40/40* (2020.01)

(58) Field of Classification Search

CPC ..... A24F 40/20; A24F 40/40; A24F 47/008

See application file for complete search history.

(56) References Cited

U.S. PATENT DOCUMENTS

| | | | | |
|---|---|---|---|---|
| 9,451,792 | B1 | 9/2016 | Alima | |
| 9,980,518 | B1 * | 5/2018 | Most | F22B 1/28 |
| 2009/0095287 | A1 * | 4/2009 | Emarlou | A61M 11/041 128/200.14 |
| 2013/0152922 | A1 | 6/2013 | Benassayag et al. | |
| 2013/0192621 | A1 * | 8/2013 | Li | A24F 40/70 131/329 |
| 2014/0216483 | A1 * | 8/2014 | Alima | A24F 47/008 131/329 |
| 2014/0314397 | A1 * | 10/2014 | Alima | A24F 47/008 392/386 |

* cited by examiner

*Primary Examiner* — Eric Yaary

(74) *Attorney, Agent, or Firm* — Allen F. Bennett; Bennett Intellectual Property

(57) ABSTRACT

A handheld portable recreational vaporizer has a rechargeable battery and a vaporizing chamber held within a unitary body. The vaporizing chamber is exposed on one end. A mouthpiece is attached over the chamber and held in place using magnets. The mouthpiece includes a removable screen bracket that holds a screen flush against the vaporizing chamber. When the mouthpiece is detached from the body, the screen bracket may be removed and cleaned using harsh chemicals and/or other sterilization procedures. This allows the screen to be cleaned more thoroughly than other components of the device. Indicator lights signal which predetermined temperature ranges the device currently operates at.

17 Claims, 3 Drawing Sheets

Fig. 1
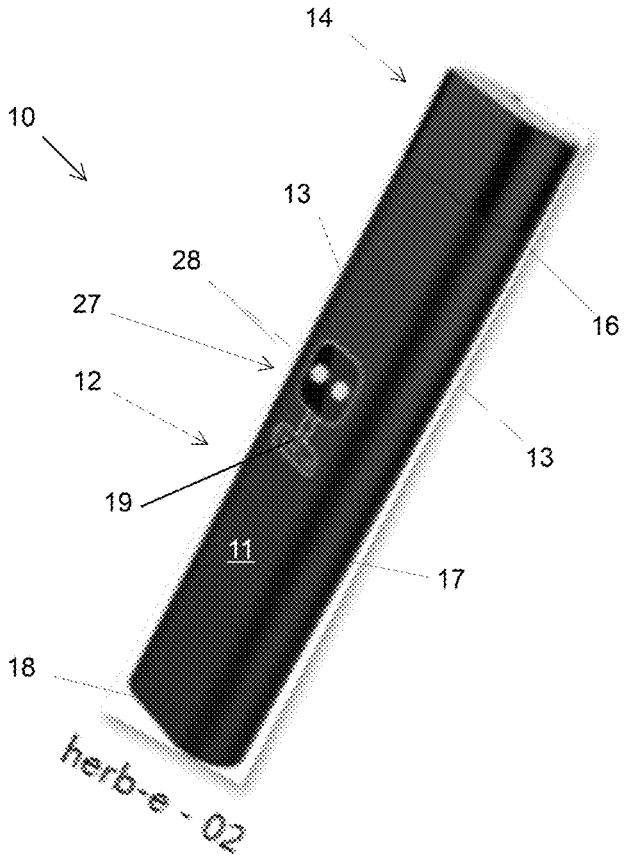
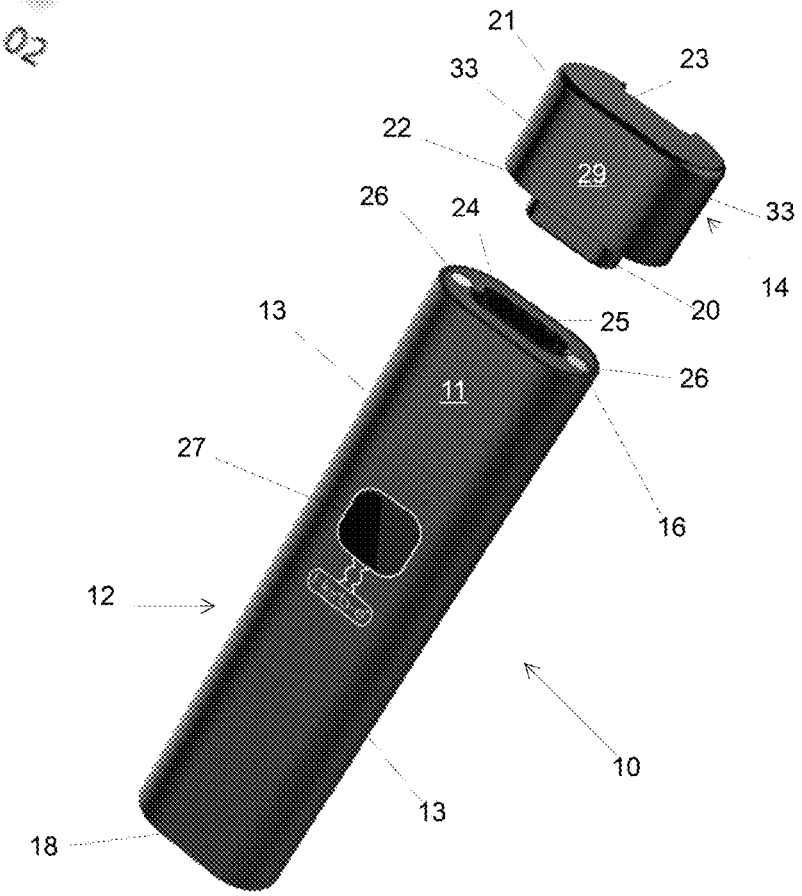
Fig. 2

VAPORIZER HAVING ADJUSTABLE ATOMIZER AND REMOVABLE SCREEN

This application claims priority to U.S. Provisional Application Ser. No. 62/538,720 filed on Jul. 30, 2017, the contents of which are hereby incorporated in their entirety.

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable

INCORPORATION-BY-REFERENCE OF THE MATERIAL SUBMITTED ON A COMPACT DISC

Not Applicable.

COPYRIGHT NOTICE

Not Applicable

BACKGROUND OF THE INVENTION

Field of the Invention

The present invention relates to a portable vaporizer. More particularly, the invention relates to a portable vaporizer having a screen in the mouthpiece that is easily removed and cleaned, and has an adjustable temperature indicated by an LED light.

Description of the Related Art

In recent years the use of vaporizers has become an increasingly common. A material is heated, thereby generating a vapor that can be inhaled. The process is very similar to the process of heating a material with hot coals in a hookah. In addition, vaporizing materials, commonly known as "vaping," is a suitable method for ingesting a wide variety of chemical compositions. Vaping has become a rapidly growing and increasingly popular industry. The introduction of smaller, more compact vaporizing devices over the past several years has contributed to the rapid growth of this industry.

However, as with all new industries, there remains several aspects of the industry and vaporizing techniques that are sub optimal and could be improved. One aspect of vaporizing devices that could be improved is the more efficient and cleaner handling of the material being heated and the removal of used, waste products. Oils and other substances are typically placed within a chamber where they are heated, thereby generating vapor. Although the material is not incinerated, the high temperatures degrade the material, often leaving a hard, sticky, resinous byproduct the can be difficult to remove or clean from a device. Typically, devices include a replaceable cartridge or chamber that is simply thrown out after use. Other devices require that a screen or other components be replaced regularly. This is wasteful, inconvenient and results in significant waste of materials.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description. In view of the foregoing, it is desirable to provide a vaporizing device having a mouthpiece that is easily cleaned and reusable for dozens or hundreds of iterations.

BRIEF SUMMARY OF THE INVENTION

Disclosed is a portable vaporizer comprising a body having a battery, and atomizer, and a vaporizing chamber. The chamber is open at a proximal end of the body. A mouthpiece has a proximal end and a distal end, and the distal end is removably affixable to the proximal end of the body. A screen bracket is removably insertable into the distal end of the mouthpiece and configured to retain a screen over the proximal end of the chamber of the body when the mouthpiece is affixed to the proximal end of the body. The device has a button for adjusting the temperature of the atomizer while the portable vaporizer is in use. An LED light indicator indicating the temperature of the atomizer by a change in color. The screen bracket has a thermostable body housing a metallic screen capable of withstanding cleaning with industrial chemicals and pressure sterilization procedures.

It is therefore an object of the present invention to provide a portable vaporizer having a removable screen that is easily cleaned.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE SEVERAL VIEWS OF THE DRAWINGS

A more complete understanding of the present invention, and the attendant advantages and features thereof, will be more readily understood by reference to the following detailed description when considered in conjunction with the accompanying drawings wherein:

FIG. 1 is a perspective view of a dry herb vaporizer in accordance with the principles of the invention;

FIG. 2 is another perspective view of a dry herb vaporizer with the mouthpiece detached in accordance with the principles of the invention;

DETAILED DESCRIPTION OF THE INVENTION

Figure 3:
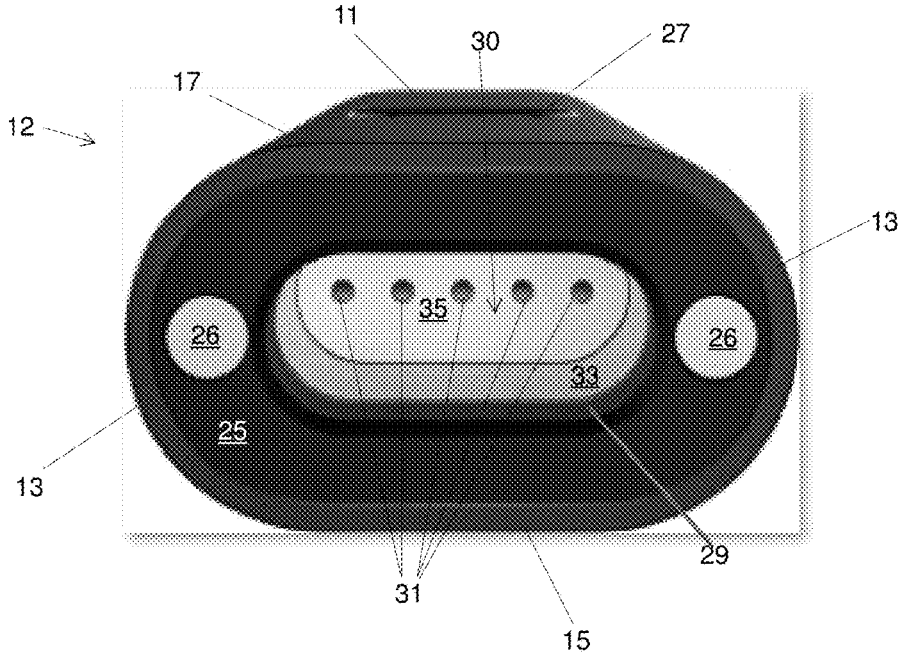
FIG. 3 is a proximal perspective view of the body of a dry herb vaporizer in accordance with the principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. As used herein, the term "vaporizer" generally interchangeable with the term "electronic cigarette" and is used to refer to a device for heating a substance to generate vapor which may then be inhaled directly from the vaporizer. This process is generally referred to as "vaping" and has become an increasingly popular method for ingesting materials in a manner that many consider to be less harmful than smoking. The term "dry herb" generally refers to dry tobacco, and more preferably crushed dried tobacco leaves. However, other dry substances may also be used in accordance with the principles of the invention.

"Distal" and "proximal" are used throughout this application to generally indicates to office at directions. "Distal" generally refers to the end of the object furthest away from an operator and specifically furthest away from the operator's mouth. "Proximal" generally refers to the indoor side of an object closest to the operator and specifically closest to an operator's mouth. The term "boss" is used in the mechanical engineering sense, that is a protrusion extending from one object and complementary to a cavity or whole in another object to facilitate proper alignments of the two objects. The term "tamp" is also used in the mechanical sense and particularly as it is used in referring to tobacco pipes. Specifically, a "tamp" or "tamper" is a device for compressing dry materials to be incinerated. "To tamp" is a verb meaning to compress material, specifically material to be incinerated. In accordance with the invention, the material that is being tamped is not incinerated, but instead heated to a temperature sufficient to generate a vapor as opposed to smoke.

FIGS. 1 and 2 show a dry herb vaporizer 10 having a body 12 and a mouthpiece 14 removably attached to the proximal end 16 of the body 12. In this embodiment, the distal end 18 of the body 12 is flat, thus allowing the dry herb vaporizer 10 to stand upright on a horizontal surface. Optionally, the distal end 18 may be curved or have another configuration. An outer wall 17 extends from the distal end 18 to the proximal end 16 and is continuous. The outer wall 17 includes a flat, planar front surface 11 and a flat, planar rear surface 15, and two curved side surfaces 13. A display panel 27 is located on the front surface 11 and includes two LED indicator lights 28. The display panel 27 also includes an on/off or control button 19 and the LED indicator lights 28 are illuminated when the dryer vaporizer 10 is turned on. The indicator lights 28 also vary in color depending on the amount of charge remaining in the battery, and in the temperature level of the heating element. For example, the LED lights 28 may be green when the vaporizer 10 is fully charged, yellow when the vaporizer battery has about half of a full charge and may turn red when the battery is almost dead. The body 12 of this embodiment has a substantially oval cross-section. Optionally, the body may have a more circular cross-section or an angular cross-section. That is, the body 12 may be configured as a parallelepiped, a hexagonal prism or most any other configuration.

The mouthpiece 14 has a distal end 22 that is removably attached to the proximal end 16 of the body 12. The mouthpiece 14 has an outer wall 21 extending from the distal end 22 to a proximal end 23. The outer wall 21 of the mouthpiece 14 has the same cross-sectional configuration as the outer wall 17 of the body 12, having a flat, planar front surface 29, a planar rear surface 31 and two curved sides 33. In this embodiment, the proximal end 23 of the mouthpiece 14 is flat, thereby allowing the dry herb vaporizer 10 to stand upright on a horizontal surface. When the mouthpiece 14 is attached to the body 12, the outer wall 17 of the body 12 lies flush with the outer wall 21 of the mouthpiece 14. Thus, the body 12 and the mouthpiece 14 when attached create the impression of a unitary dry herb vaporizer 10.

The mouthpiece 14 also includes a tamping boss 20 which protrudes from the distal end 22 of the mouthpiece 14 and is complementary to the opening 24 in the proximal end 16 of the body 12. When the mouthpiece 14 is attached to the body 12, the tamping boss 20 extends into the opening 24 and partially into the heating chamber 30. In use, dry herb material is first placed within the heating chamber 30. Next, the mouthpiece 14 is attached to the proximal end 16 of the body 12. The tamping boss 20 extends into the heating chamber 30 and impinges on and tamps down the dry herb material in the chamber 30. The tamping boss 20 is described in more detail below.

FIG. 3 shows the proximal end 16 of the body 12 in more detail. The proximal end 16 of the body 12 includes a central opening 24 defined by a rim 29. A flat, planar shoulder 25 encircles the rim 29 of the opening 24 and extends between the rim 29 and the outer wall 17. In this embodiment, two magnetic connectors 26 are located on opposite sides of the shoulder 25 in the regions of the curved sides 13. Optionally, the magnetic connectors 26 may be located at other points on the shoulder 25, and/or several additional connectors may be distributed around the shoulder 25. Alternatively, the entire shoulder 25 may be a magnetic connector.

The central opening 24 leads into a heating chamber 30 defined by a chamber wall 33 extending from the rim 29 to a back wall 35. The chamber wall 33 is preferably insulated. The back wall 35 is adjacent to a heating element, not shown, that heats both the heating chamber 30 itself and optionally air traveling through the heating element and into the heating chamber 30 through passages 31.

Figure 4:
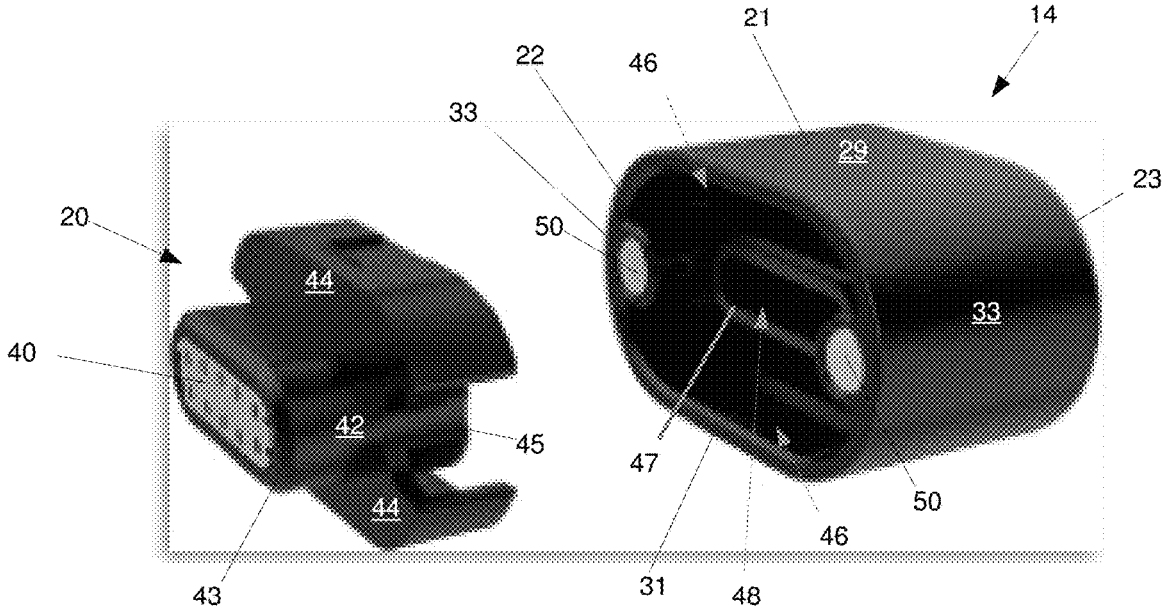
FIG. 4 is an exploded view of a mouthpiece of a dry herb vaporizer in accordance with the principles of the invention.

FIG. 4 shows the mouthpiece 14. In this embodiment, the tamping boss 20 is removable from the mouthpiece 14 and is defined by a sidewall 42. The tamping boss 20 houses a rigid air permeable tamping plate 40 at its terminating end 43. The tamping boss 20 also includes two tabs 44 extending in a proximal direction from the sidewall 42. Tabs 44 are complimentary to two slots 46 in the distal end 22 of the mouthpiece 14. The tamping boss 20 is attached to the mouthpiece 14 by sliding the tabs 44 into the slots 46. The tamping boss 20 is sized such that it is complementary to the heating chamber 30 and its sidewall 42 lies flush against the chamber wall 33 when the tamping boss 20 is inserted into the opening 24.

To remove the tamping boss 20 from the mouthpiece 14, an operator simply pulls the tamping boss 20 in a distal direction. The tabs 44 form a friction fit with the slots 46 that may be either loose or tight. Because the tamping boss 20 is positioned entirely between the body 12 and the mouthpiece 14, it is not necessary for the tabs 44 and slots 46 to form a particularly strong friction fit. It may be desirable for the tabs 44 to slide freely out of the slots 46. The sidewall 42 defines an internal passage that aligns with the air passage 48 in the mouthpiece to form a continuous passage from the tamping plate 40 to the proximal end 23 of the mouthpiece 14. In this embodiment, the proximal end 45 of the sidewall 42 slides over and is flush against the protruding lip 47 that forms the distal rim of the passage 48. Alternatively, the proximal end 45 of the sidewall 42 may simply abut the lip of the passage 48.

During use, vapor produced from the dry herb product within the heating chamber 30 travels to an operator's mouth through the tamping plate 40, the sidewall 42 and the passage 48 to the operator's mouth which engages the proximal end 23 of the mouthpiece 14. The distal end 22 of the mouthpiece 14 also has two magnetic connectors 50 complementary to the magnetic connectors 26 at the proximal end 16 of the body 12 of the device 10.

Figure 5:
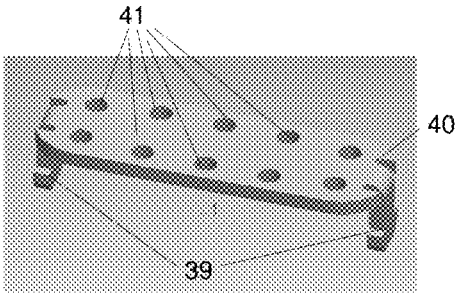
FIG. 5 is a perspective view of a tamping plate of a dry herb vaporizer in accordance with principles of the invention.

FIG. 5 shows the tamping plate 40 which has been removed from the tamping boss 20. The tamping plate has a plurality of openings 41, making it air permeable. The number of an arrangement of holes 41 in the tamping plate 40 may vary so long as the tamping plate 40 is sufficiently rigid to tamp materials within the heating chamber 30 and also air permeable enough to provide sufficient flow of vapor from the heating chamber 30 through the passage 48 to an operator's mouth. The tamping plate 40 includes two lateral snap fit tabs 43 that allow it to be removably insertable into the terminal end 43 of the conduit 20.

Figure 6:
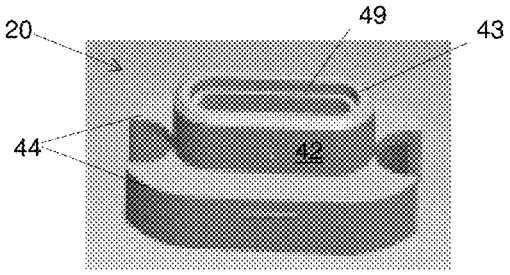
FIG. 6 is a perspective view of a tamping boss of a dry herb vaporizer in accordance with the principles of the invention.

FIG. 6 shows the tamping boss 20 with the tamping plate 40 removed. The tamping plate 40 is removably insertable into the terminating end 43 of the sidewall 42. The snap fit tabs 39 snap into slots inside the sidewall 42 and the tamping plate 40 rests on an internal shoulder 49. Because both the tamping boss 20 and the tamping plate 40 are removable, the dry herb vaporizer 10 is easier to clean and maintain in good condition.

Figure 7:
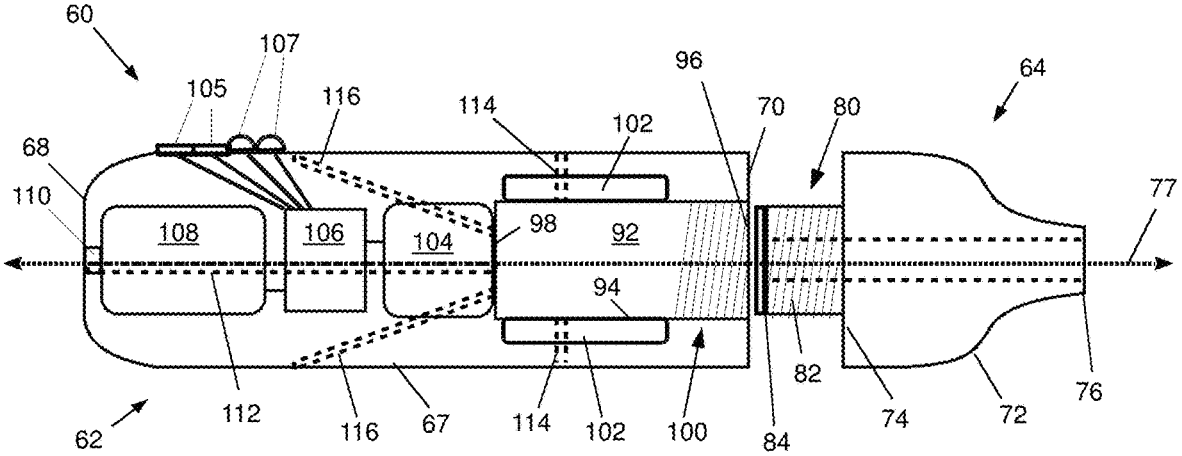
FIG. 7 is a cross-sectional view of an alternative embodiment of a dry herb vaporizer in accordance with the principles of the invention.
Figure 8:
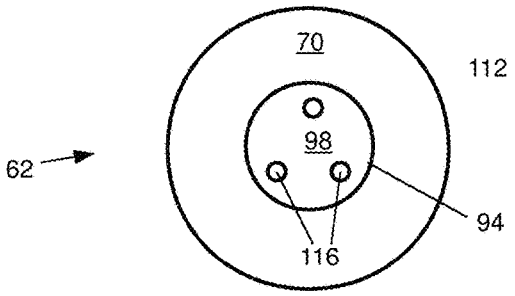
FIG. 8 is a proximal view of a body of an alternative embodiment of a dry herb vaporizer in accordance with principles of the invention.
Figure 9:
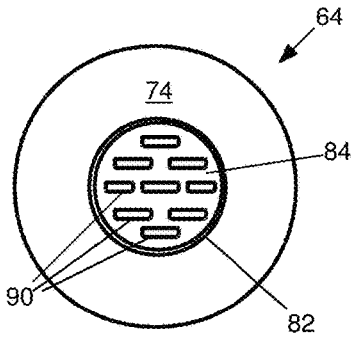
FIG. 9 is a distal view of a mouthpiece of an alternative embodiment of a dry herb vaporizer in accordance with principles of the invention.

FIGS. 7-9 show an alternative embodiment of a dry herb vaporizer 60 in accordance with the principles of the invention. The herb vaporizer 60 has a body 62 and a mouthpiece 64. The body 62 has an outer wall 67 extending from a distal end 68 to a proximal end 70. The mouthpiece 64 has an outer wall 72 extending from a distal end 74 to a proximal end 76. The outer wall 67 of the body 62 has an elliptical ogive shape, the outer wall 72 of the mouthpiece 64 has an ogee shape. Both outer wall 67 and 72 are radially symmetric about a longitudinal axis 77.

In this embodiment, the mouthpiece 64 is unitary and does not have a removable tamping boss. Tamping boss 80 extends from the center of the distal end 74 and has a threaded sidewall 82. A tamping plate 84 is located at the terminal end of the tamping boss 80. The tamping plate is rigid and includes a plurality of holes 90 that make it air permeable. An air passage 88 extends from the tamping plate 84 to the proximal end 76.

The body 62 of this embodiment has a heating chamber 92 having a chamber wall 94 extending from an opening 96 in the proximal end 70 to a back wall 98. A proximal region 100 of the chamber wall 94 is threaded and therefore threadably engageable with the sidewall 82 of the tamping boss 80. Because the tamping boss 80 screws into the heating chamber 92, an operator can adjust the extent to which dry herb material is tamped. The body 62 includes two lateral heating elements 102 and a backwall heating element 104. A microcontroller 106 controls the temperature of the heating elements 102 and 104, and actuates the indicator lights 107 on the outer wall 67 that indicate the current status of the vaporizer 60, such as how charged the battery is and the heating temperature selected. A battery 108 is in communication with a micro USB port 110 that allows a power cord to supply power and recharge the battery 108. The microcontroller 106 is in communication with the battery 108, the hearing elements 102 and 104, control switches 105 used to adjust the settings of the device 60, and indicator lights 107. The microcontroller adjusts the heating elements between two or more temperature settings. An operator may prefer different temperatures for vaporizing different types of tobacco or other herbs, and the microcontroller provides that option. The temperature settings are adjusted by actuating the control buttons 105. Optionally, the device may include a Bluetooth® or other near field wireless capability and the settings of the vaporizer may be adjusted using a phone app. The vaporizer may also be adjusted using software accessing the microcontroller via the USB port.

The body 62 also includes a plurality of air passages that supply air to the heating chamber. In the ventral air passage 112 extends distally from the back wall 98 of the heating chamber 92 and is in fluid communication with the USB port 110. The ventral air passage 112 passes through the heating element 104, heating and air as it goes into the heating chamber 92. Lateral air passages 114 extend laterally or outward from the chamber wall 94 to the outer wall 67. Sound, all, or none of the lateral air passages 114 may pass through the lateral heating elements 102. Diagonal air passages 116 extend in a diagonal direction from the back wall 98 of the heating chamber 92 and may or may not pass through the heating element 104. The number and geometry of the air passages and whether or not they are heated by the heating elements will affect the airflow through the heating chamber.

In one embodiment, during use, an operator first charges the battery if it is dead or low on power. The LED indicator lights will emit a pattern indicating that the device is charging, and the pattern will change once the device is charged. For example, a red LED light will turn off when the device is fully charged. In this embodiment, when the battery has low-power, for example 10% of charge, the indicator light will flash 8 times or otherwise indicates that power is low.

Once charged, an operator will insert a dry herb product into the heating chamber. An operator may for example use medium ground tobacco or other material. A packing tool, such as for example a common pipe tool, may be used to properly fill the heating chamber with the selected material. The operator then attaches the mouthpiece to the body, simultaneously tamping the dry herb product in the heating chamber. The operator then selects a temperature setting and actuates the heating element or elements to heat the dry herb product to a desired temperature. The operator then applies his or her mouth to the proximal end of the mouthpiece and apply suction to the air passage. This negative pressure pulls air through the air passages, into the heating chamber where it mixes with vapor and then into the operator's mouth for inhalation.

In one embodiment, an operator can then press the control button 5 times to turn on the device. The indicator lights may flash yellow until an optimal temperature is achieved. Once the device has reached the preferred temperature, the indicator lights remain on continuously emitting yellow lights. After three minutes, the device will automatically shut down to cool. In one embodiment of a method of use, an operator allows five-minute intervals between uses of the device.

Optionally, an operator may depress the control button for three seconds while the device is already on. This will cause the indicator lights to turn red and will increase the temperature applied to the chamber. This will increase the amount of vaping and may also result in some incidental incineration. To turn off the device, an operator presses the control button three times rapidly.

When cleaning the device, an operator disconnects the mouthpiece and removes the tamping plate. Both the tamping plate and the mouthpiece may be thoroughly cleaned with 70% rubbing alcohol or other solvents to remove sticky residue and other debris.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A dry herb vaporizer comprising:

a body defined by an outer wall extending between a distal end to a proximal end, the proximal end having a central opening;

a heating chamber within the body and defined by a chamber wall extending into the body from a rim of the central opening to a back wall;

a heating element housed within the body and located adjacent to the heating chamber;

a mouthpiece having an outer wall extending from a distal end to a proximal end;

a tamping boss protruding from the distal end of the mouthpiece and terminating at an air permeable, rigid tamping plate;

a central passage through the mouthpiece extending from the tamping plate to an opening at the proximal end of the mouthpiece;

wherein the mouthpiece is removably attachable to the body such that the central conduit of the mouthpiece is aligned with the central opening of the body;

a rechargeable battery housed within the body;

at least one air passage extending from an exterior of the body to the heating chamber.

2. The dry herb vaporizer of claim 1 wherein the tamping boss has a sidewall that lies flush against the heating chamber wall when the mouthpiece is attached to the body.

3. The dry herb vaporizer of claim 2 further comprising a display panel on the outer wall of the body and a microcontroller housed within the body and controlling the heating element and the display panel.

4. The dry herb vaporizer of claim 2 wherein the at least one air passage extends through the heating element and the heating chamber's backwall.

5. The dry herb vaporizer of claim 2 wherein the tamping boss is removably attachable to the mouthpiece.

6. The dry herb vaporizer of claim 5 wherein the tamping plate is housed in a screen bracket removably attachable to the distal end of the mouthpiece.

7. The dry herb vaporizer of claim 6 wherein the tamping boss comprises a conduit having a tamping plate at a terminating end.

8. The dry herb vaporizer of claim 7 further comprising two tabs that extend in a proximal direction from a proximal end of the conduit and are complementary to two slots in the distal end of the mouthpiece.

9. The dry herb vaporizer of claim 8 wherein the distal end of the screen bracket sleeve is sized to fit within the opening in the proximal end of the body such that the sleeve lies flush against the heating chamber wall.

10. The dry herb vaporizer of claim 9 wherein the tamping plate is removable from the tamping boss.

11. The dry herb vaporizer of claim 10 wherein the proximal end of the body includes one or more magnetic connectors and the distal end of the mouthpiece includes one or more magnetic connectors complementary to the connectors of the body.

12. The dry herb vaporizer of claim 11 wherein the heating element is actuated by the pressing a button on the outer wall of the body.

13. The dry herb vaporizer of claim 12 wherein the heating element may be adjusted between three or more different temperature settings.

14. The dry herb vaporizer of claim 13 further comprising an indicator panel having one or more LED indicator lights.

15. A method for vaporizing a dry herb comprising:

providing a dry herb heating chamber housed within a vaporizer body and defined by a chamber wall extending from an opening in a proximal end of the vaporizer body to a backwall inside the vaporizing body, at least one heating element, and a plurality of air channels supplying air from an exterior of the body to the heating chamber;

providing a mouthpiece having a distal end removably attachable to the proximal end of the vaporizer body and a central passage extending through the mouthpiece and aligned with the opening into the dry herb heating chamber;

affixing a removable tamping boss to the distal end of the mouthpiece, the tamping boss defined by a sidewall extending in a distal direction and having a tamping plate at a terminating end;

inserting a dry herb product into the heating chamber;

attaching the distal end of the mouthpiece to the proximal end of the vaporizer body such that the tamping boss partially extends into the opening to the heating chamber such that the sidewall of the tamping boss lies flush against the chamber wall;

selecting a temperature for heating the dry herb product;

actuating the heating element, thereby heating the dry herb product to a temperature sufficient to generate vapor from the dry herb; and, applying suction to the heating chamber through the screen and the central bore of the mouthpiece.

16. The method for vaporizing a dry herb of claim 15 further comprising securing the mouthpiece to the body by aligning a pair of magnetic connectors on the distal end of the mouthpiece with complementary metal connectors on the proximal end of the body.

17. The method for vaporizing a dry herb of claim 16 wherein the removable tamping boss is affixed to the mouthpiece by inserting two proximally extending tabs on a proximal end of the tamping boss into two slots on the distal end of the mouthpiece.

* * * * *